US007980032B2

(12) United States Patent
Moffatt

(10) Patent No.: US 7,980,032 B2
(45) Date of Patent: Jul. 19, 2011

(54) CONSTRUCTION UNIT MOUNTING SYSTEM

(76) Inventor: Andrew M. Moffatt, Abbotsford (CA)

( * ) Notice: Subject to any disclaimer, the term of this patent is extended or adjusted under 35 U.S.C. 154(b) by 0 days.

(21) Appl. No.: 12/904,298

(22) Filed: Oct. 14, 2010

(65) Prior Publication Data

US 2011/0056054 A1 Mar. 10, 2011

Related U.S. Application Data

(63) Continuation of application No. 11/200,026, filed on Aug. 10, 2005, now Pat. No. 7,814,716, which is a continuation of application No. PCT/CA03/01975, filed on Dec. 24, 2003, and a continuation-in-part of application No. 10/360,740, filed on Feb. 10, 2003, now Pat. No. 6,895,718.

(51) Int. Cl.
*E06B 3/00* (2006.01)

(52) U.S. Cl. ..... 52/204.55; 52/214; 52/204.599; 52/213; 52/712

(58) Field of Classification Search ..... 52/204.55, 52/214, 204.599, 213, 712
See application file for complete search history.

(56) References Cited

U.S. PATENT DOCUMENTS

| | | | |
|---|---|---|---|
| 1,599,985 | A | 9/1926 | Carlson |
| 2,075,955 | A | 4/1937 | Parsons |
| 2,497,515 | A | 2/1950 | Pearse |
| 2,840,203 | A | 6/1958 | Hehr |
| 3,093,217 | A | 6/1963 | Doede |
| 3,189,137 | A | 6/1965 | Harris |
| 3,201,831 | A | 8/1965 | Cudini |
| 3,226,781 | A | 1/1966 | Schnabel |
| 3,238,679 | A | 3/1966 | Capoccia |
| 3,276,179 | A | 10/1966 | Rallis |
| 3,320,705 | A | 5/1967 | Downing, Jr. |
| 3,468,064 | A | 9/1969 | Melanson et al. |
| 3,636,672 | A | 1/1972 | Fink |
| 3,693,495 | A | 9/1972 | Wagner |
| 3,823,524 | A | 7/1974 | Weinstein |
| 3,925,953 | A | 12/1975 | LaBorde |
| 3,992,769 | A | 11/1976 | Jackson |
| 4,048,774 | A | 9/1977 | Yamamoto |
| 4,079,553 | A | 3/1978 | Kirk, Jr. |
| 4,274,235 | A | 6/1981 | Langenhorst |
| 4,387,542 | A | 6/1983 | Wehr |
| 4,418,506 | A | 12/1983 | Weber et al. |

(Continued)

FOREIGN PATENT DOCUMENTS

| | | |
|---|---|---|
| DE | 7517362 | 9/1975 |

(Continued)

*Primary Examiner* — Laurie K Cranmer
(74) *Attorney, Agent, or Firm* — Oyen Wiggs Green & Mutala LLP

(57) ABSTRACT

A clip is provided for affixing a construction unit to a building structure. The clip comprises: a generally planar middle portion, an exterior portion located on an exterior side of the middle portion and an interior portion located on an interior side of the middle portion; the exterior portion comprising a groove at an exterior end of the clip for receiving a construction unit flange, the groove having a generally U-shaped cross-section, the groove defined at least in part by a pair of generally parallel groove portions and a base portion connecting the groove portions at a base of the groove, the base of the groove spaced apart from an opening of the groove; the middle portion extending from an interior side of groove toward the interior portion; and the interior portion at an interior end of the clip, the interior portion extending from the middle portion at an obtuse angle to define a fulcrum at a junction between the middle portion and the interior portion.

20 Claims, 6 Drawing Sheets

U.S. PATENT DOCUMENTS

| | | | |
|---|---|---|---|
| 4,447,985 | A | 5/1984 | Weber et al. |
| 4,473,981 | A | 10/1984 | Simpson |
| 4,527,369 | A | 7/1985 | Adams |
| 4,635,400 | A | 1/1987 | Mullet |
| 4,640,072 | A | 2/1987 | Muhle |
| 4,986,044 | A | 1/1991 | Funari |
| 5,038,537 | A | 8/1991 | Frambach |
| 5,579,616 | A | 12/1996 | Farag |
| 5,692,350 | A | 12/1997 | Murphy, Jr. |
| 5,705,002 | A | 1/1998 | Sherry |
| 5,722,207 | A | 3/1998 | Anderson et al. |
| 5,771,644 | A | 6/1998 | Kidd |
| 6,216,402 | B1 | 4/2001 | Van de Laar |
| 6,253,496 | B1 | 7/2001 | Gilchrist |
| 6,293,061 | B1 | 9/2001 | Horak, Jr. |
| 6,357,200 | B1 | 3/2002 | Vanderpan |
| 6,361,193 | B1 | 3/2002 | Gabrius et al. |
| 6,500,550 | B1 | 12/2002 | Tsuboi et al. |
| 7,096,640 | B1 | 8/2006 | Chevian et al. |

FOREIGN PATENT DOCUMENTS

| | | |
|---|---|---|
| JP | S51-145738 | 5/1976 |
| JP | S62-203393 | 12/1987 |
| JP | 2000-087651 | 3/2000 |
| JP | 2000-234480 | 8/2000 |
| WO | 8403120 | 8/1984 |

CONSTRUCTION UNIT MOUNTING SYSTEM

RELATED APPLICATIONS

This application is a continuation of U.S. application Ser. No. 11/200,026 filed 10 Aug. 2005 which itself is a continuation of Patent Cooperation Treaty application No. PCT/CA03/001975 filed 24 Dec. 2003 and a continuation-in-part of U.S. application Ser. No. 10/360,740 filed 10 Feb. 2003.

TECHNICAL FIELD

The invention relates to mounting prefabricated construction units in apertures in building envelopes. Particular embodiments of the invention have application to a system for mounting windows in apertures in a building envelope.

BACKGROUND

Today most windows are provided in the form of a unit which includes one or more glass panes mounted in a frame. The glass panes typically comprise sealed double-or triple-glazed panels. The frame is typically made of vinyl or another plastic material which does not conduct heat well although some aluminum-framed window units are still sold. The frame of each window unit typically includes a broad flange which projects in a lateral direction and extends around the periphery of the window unit. Other types of prefabricated construction units such as doors, vents and sunlights may have similar flanges.

A typical wood frame building has a frame of wooden members which includes apertures for prefabricated construction units such as windows, doors, vents, sunlights and the like. An appropriately-sized construction unit is received in each of the apertures with the flange overlapping with and abutting the outside of the building frame. The construction units are typically secured in place by placing a few screws or nails through the flange into the building frame on each side of the construction units.

One disadvantage of the way that construction units are currently installed is that a person must be outside of the building to install the construction units. This is especially problematic for window units, since window apertures may be located well above ground level. Windows in such locations are often installed by a person standing on a ladder. This can be dangerous, especially if the weather is windy or during winter conditions.

Another disadvantage of the way that construction units are currently installed is that many buildings have a waterproofing membrane applied to their exterior. Puncturing the membrane with screws or nails reduces the effectiveness of the membrane.

There is a need for more efficient ways to install construction units.

SUMMARY OF THE INVENTION

This invention provides prefabricated construction units with tabs which can be used to affix the construction units in place in the apertures of a building wall from inside the building. One aspect of the invention provides a clip for use in affixing a construction unit to a building structure. The clip comprises a thin tab having a transverse groove at an exterior end thereof for receiving a flange of a frame of the construction unit and at least one attachment point at an interior end thereof. The attachment point may comprise, for example, an aperture and/or a projection which projects from the tab. The clip can be affixed to a frame by inserting a flange of the frame into the groove. The attachment point can be used to affix the clip to a building structure.

Another aspect of the invention provides a clip for affixing a construction unit to a building structure. The clip comprises an exterior end and an interior end. The exterior end of the clip has means for affixing the clip to a frame of a construction unit. The interior end of the clip comprises means for affixing the interior end of the clip to a building structure. Various means for performing these functions are described below.

A still further embodiment of the invention provides a construction unit comprising a frame; a flange projecting laterally from the frame around a periphery of the frame; and, a plurality of tabs projecting from the frame in an interior direction. Each of the tabs is attached to the frame at an exterior end thereof and comprises at least one attachment point at an interior end thereof. The attachment point comprises an aperture and/or a projection which projects from the tab.

Yet another aspect of the invention provides methods for installing a construction unit in an aperture in a wall of a building structure. One such method comprises affixing a plurality of tabs to a frame of a construction unit with the tabs projecting interiorly from the frame; placing the construction unit into the aperture; and, affixing an interior end of the tabs to the building structure.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
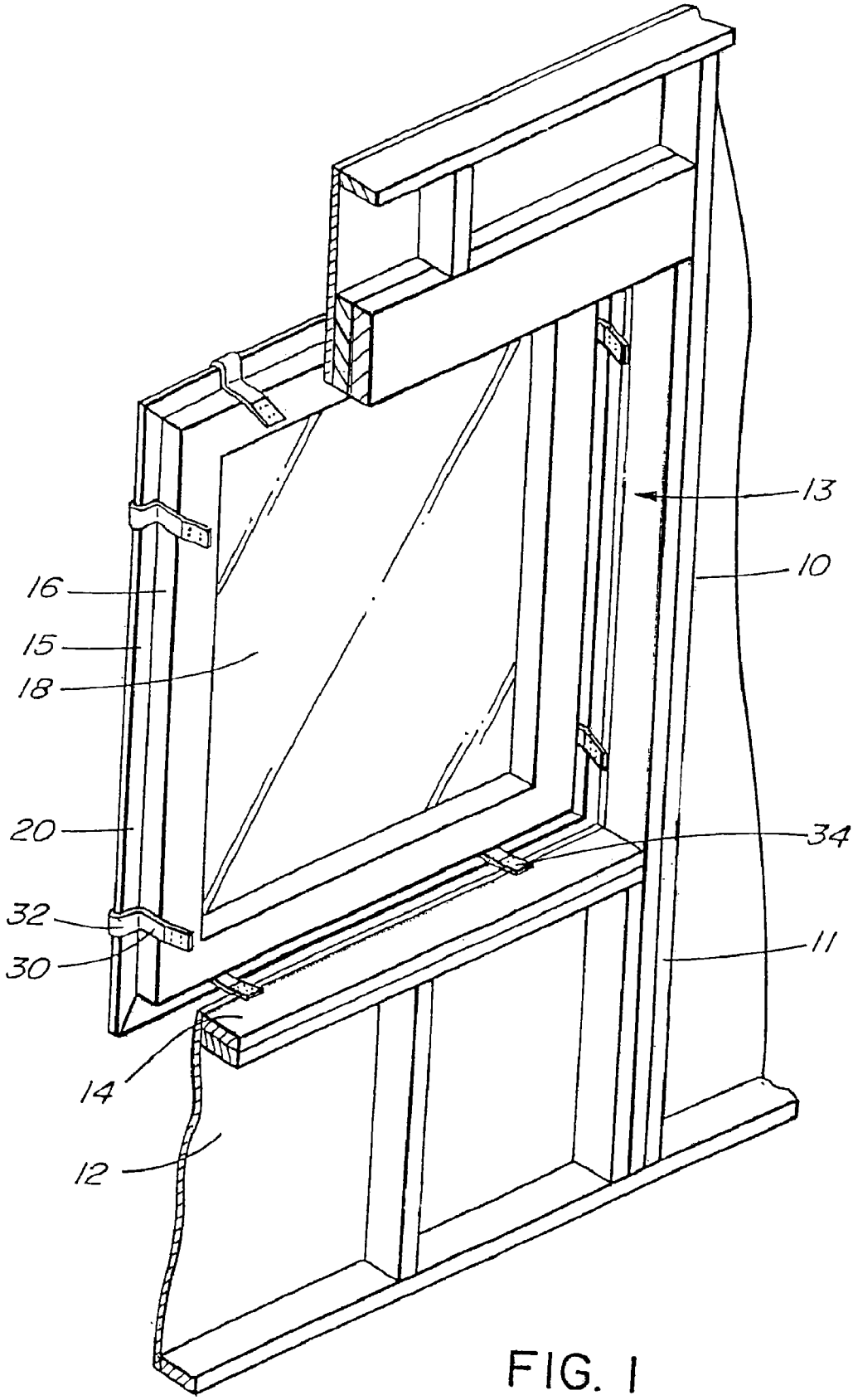
FIG. 1 is a partially cut-away isometric view of a window being installed in a building structure with the use of mounting clips according to the invention.

FIG. 1 shows a portion of the frame 10 of a typical wood-framed structure. Frame 10 comprises wooden studs 11 covered on the exterior by sheathing 12. Frame 10 includes an aperture 13 surrounded by wooden framing members 14 for receiving a window unit 15. Window unit 15 includes a window frame 16, which may be made from any suitable material, and a glass panel 18.

Window unit 15 is illustrated as being four-sided. The invention may also be used with construction units having other shapes such as triangular, round, semi-circular, polygonal etc.

Window frame 16 includes a flange 20 which projects in a lateral direction around the periphery of window frame 16. Aperture 13 is smaller than the outer dimension of flange 20 and is dimensioned to receive window frame 16 while flange 20 bears against the exterior surface of sheathing 12.

This invention provides clips 30. Each clip 30 has an exterior end 32 adapted to engage window frame 16 and an interior end 34 adapted to be fastened to building frame 10 from the inside of building frame 10. Clips 30 are used by affixing one or more clips 30 to each side of window frame 16. In the example shown in FIG. 1, two clips 30 are affixed to each side of window frame 16. For larger window units, three or more clips 30 might be affixed to each side of window frame 16. In most cases, two or more clips 30 will be affixed to each side of window frame 16.

Figure 2:
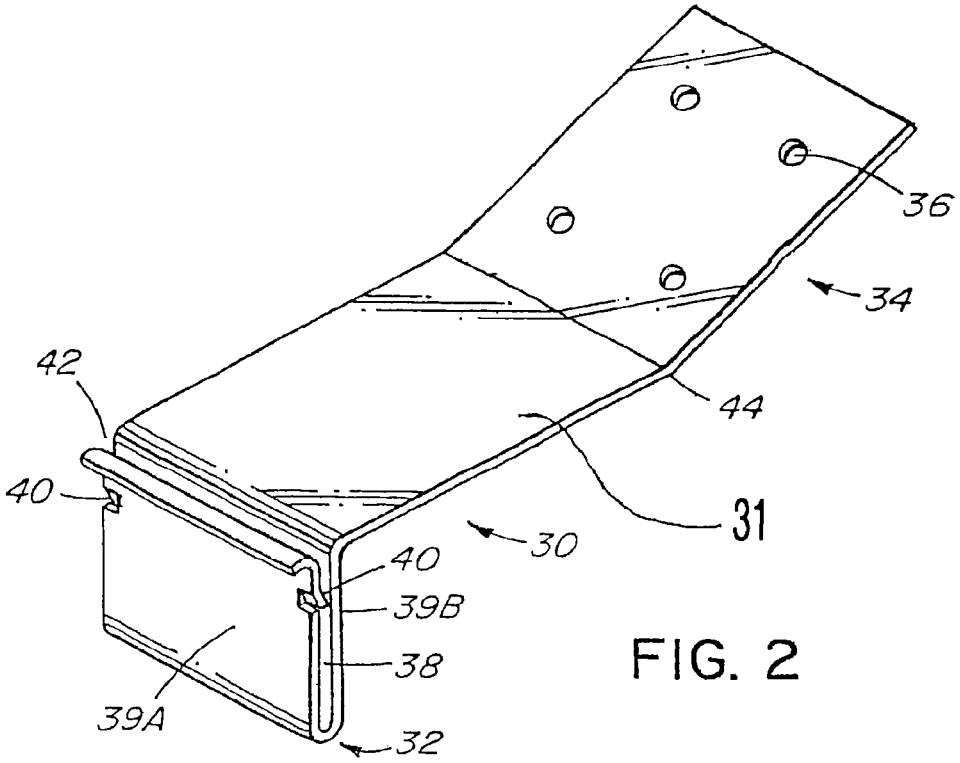
FIG. 2 is an isometric view of a window mounting clip according to a particular embodiment of the invention.

In the illustrated embodiment of the invention clips 30 attach to flange 20. FIG. 2 shows a clip 30 in greater detail. Clip 30 is formed from a strip of any suitable material, such as steel, strong plastic, or the like. The material of clip 30 is preferably resilient. In some embodiments, clip 30 may be coated with a coating layer (not shown) which is thermally non-conductive relative to the material of clip 30. For example, such a coating layer may comprise rubber, plastic, vinyl, fiberglass or the like. Such a coating layer may help to reduce or prevent condensation on the surface(s) of clip 30. In some embodiments, a coating layer may be provided on the contact surface(s) of clip 30. Interior end 34 of clip 30 comprises one or more apertures 36 which can receive fasteners, such as screws or nails, to affix interior end 34 to building structure 10. Apertures 36 constitute one possible means for affixing interior end 34 to a building structure.

Figure 3:
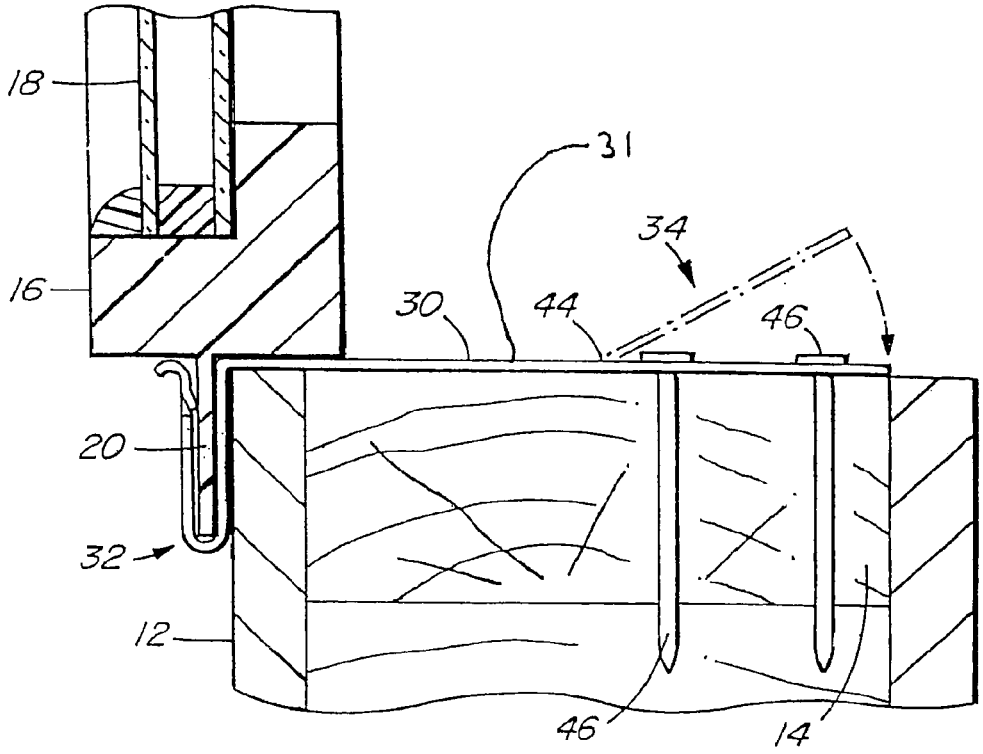
FIG. 3 is a cross-section through a portion of a window installed in an aperture in a building frame using window mounting clips of the type shown in FIG. 2.

Exterior end 32 of clip 30 is bent to define a deep groove 38. As shown in FIG. 3, groove 38 is deep enough to receive flange 20 of window frame 16. The portions 39A and 39B of clip 30 on either side of groove 38 are preferably (but not necessarily) resiliently biased toward one another, so that clip 30 tends to grip flange 20. Inwardly-angled teeth 40 (FIG. 2) may optionally be provided on one or both sides of groove 38. After flange 20 is received in groove 38, teeth 40 bite into flange 20 and resist any forces which might tend to pull flange 20 out of groove 38.

An outer side 42 of groove 38 may be tapered so that it is easy to guide flange 20 into groove 38. As flange 20 is introduced into side 42 of groove 38, it tends to wedge portions 39A and 39B apart so that flange 20 is held securely in groove 38.

Clip 30 is preferably (but not necessarily) bent at a location intermediate ends 32 and 34. The bend defines a fulcrum 44. As shown in FIG. 3, when end 34 is fastened to structure 10, clip tends to pivot about fulcrum 44 so that end 32 is biased into even firmer engagement with flange 20. Clip 30 is preferably resiliently flexible. As end 34 is fastened to building structure 10 by fasteners, such as nails 46, clip 30 is straightened.

Providing a bend in clip 30 also facilitates affixing clip 30 to building structure 10 with fasteners (for example nails or screws) which are angled in an inward direction. When such fasteners are tightened, clips 30 are drawn inwardly and pull window frame 16 firmly into the aperture.

Figure 4A:
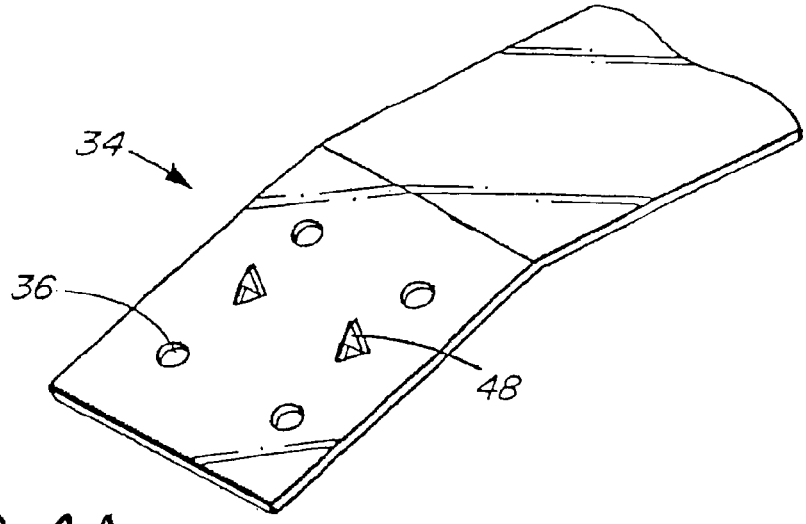
FIGS. 4A, 4B and 4C are isometric views of end portions of window mounting clips according to alternative embodiments of the invention.
Figure 4B:
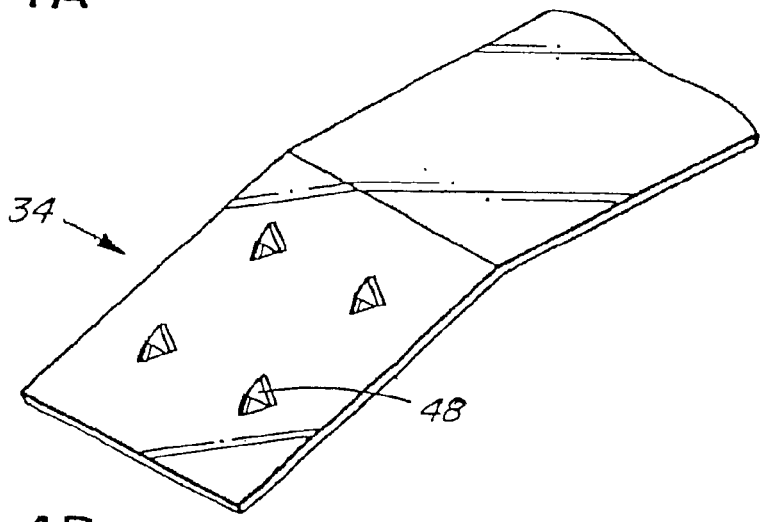
Figure 4C:
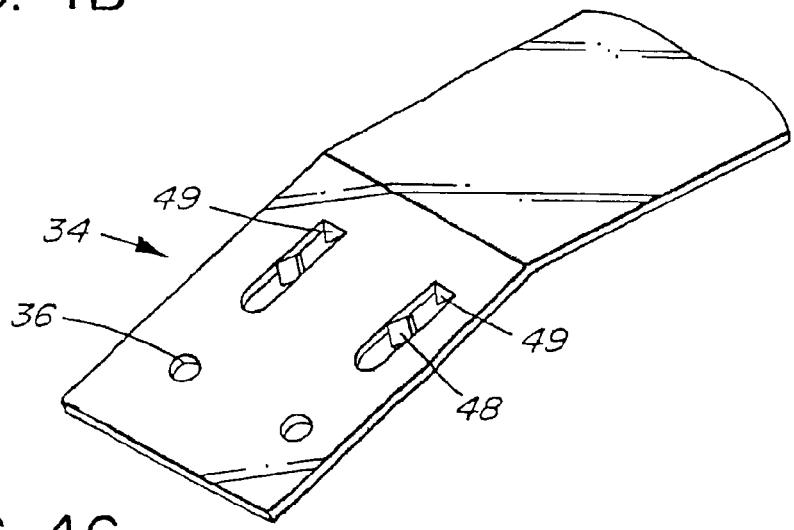

FIGS. 4A, 4B and 4C illustrate a number of alternative configurations for interior end 34. In each of FIGS. 4A, 4B and 4C, end 34 includes a number of projections 48 which project from clip 30 and which may be driven into framing members 14 (FIG. 1) when clip 30 is affixed to a window frame 16. In the illustrated embodiments, projections 48 are integral with the material of the body of clip 30 and are formed by bending flaps of the material of clip 30. Projections 48 may be triangular, as shown in FIGS. 4A and 4B, or may have more elongated shapes, as shown in FIG. 4C, or may have other shapes. The embodiments of FIGS. 4A and 4C comprise both apertures 36 and projections 48. Projections 48 may project at right angles to end 34 of clip 30. In alternative embodiments, projections 48 capable of use for affixing end 34 to building structure 10 could comprise separate elements affixed to end 34 in any suitable manner. For example, suitable projections 48 could be spot-welded to end 34. Projections affixed to end 34 provide an alternative means for affixing end 34 to a building structure 10.

In the embodiment of FIG. 4C, projections 48 are located near the ends of flexible fingers 49.

Projections 48 are not necessarily large enough to permanently affix ends 34 to a building structure 10. In some embodiments, projections 48 may be used to temporarily hold ends 34 to the building structure until screws or nails are inserted through apertures 36.

Figure 5A:
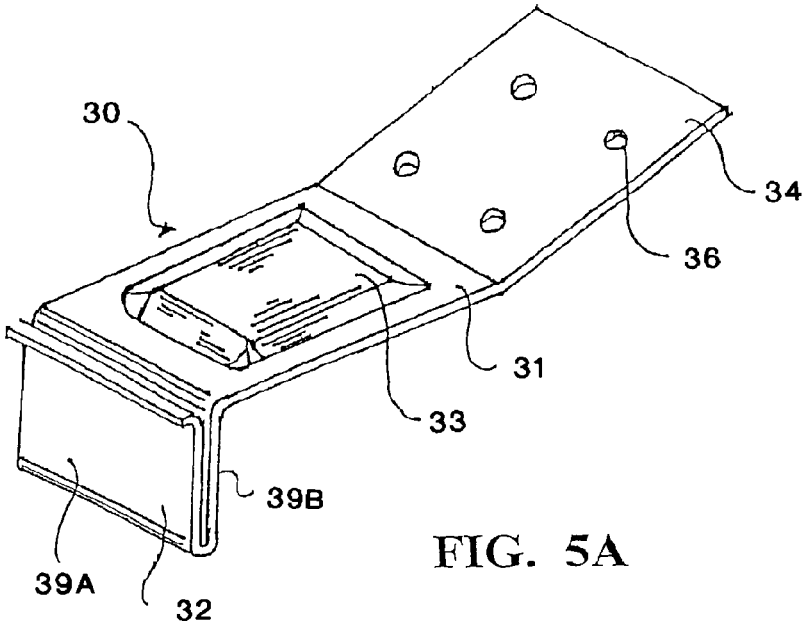
FIG. 5A is an isometric view of a window mounting clip according to another embodiment of the invention.
Figure 5B:
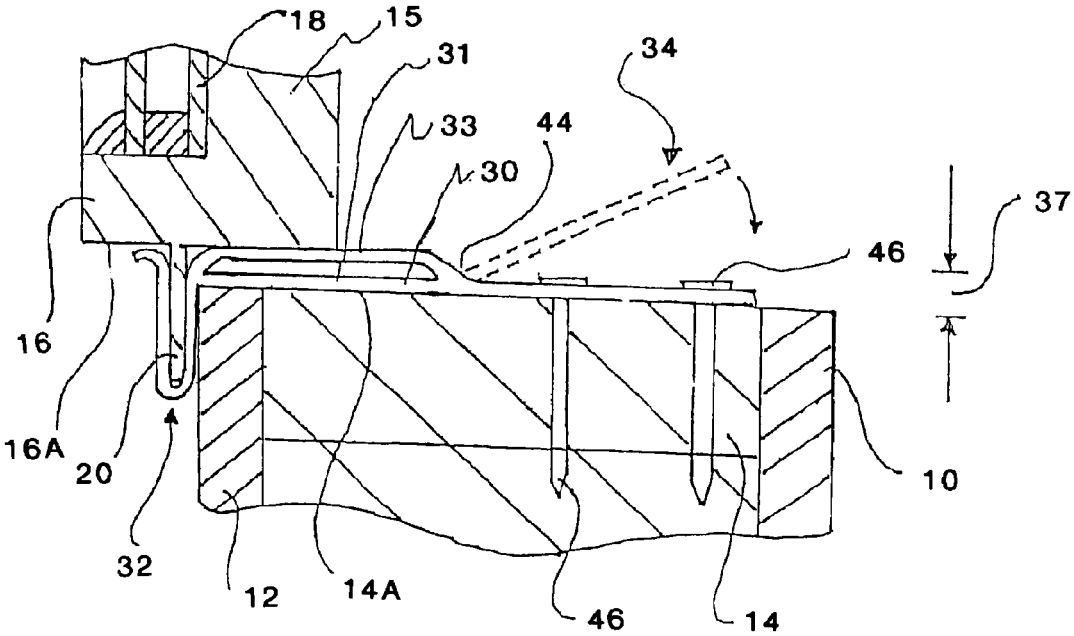
FIG. 5B is a cross-section through a portion of a window installed in an aperture in a building frame using window mounting clips of the type shown in FIG. 5A.

FIGS. 5A and 5B illustrate a clip 30 according to another embodiment of the invention. In the embodiment of FIGS. 5A and 5B, clip 30 comprises a protuberance 33 which projects upwardly from a surface of middle portion 31. When window unit 15 is mounted in a building aperture 23 using clips 30 of the type shown in FIGS. 5A and 5B, protuberances 33 create a gap 37 between the uppermost edge 14A of framing members 14 and a lower edge 16A of window frame 16. Gap 37 extends between adjacent clips 30 on the same side of window unit 15. Gap 37 may be used to facilitate the exchange of gas and/or moisture between the exterior and interior of a building, and to facilitate the escape of gas and/or moisture from between the layers of a building wall.

Although FIG. 5B depicts clip 30 in use on a lower side of window unit 15, it will be appreciated that clips incorporating protuberance 33 may be used to create gaps 37 on other sides of window unit 15. Protuberance 33 depicted in FIGS. 5A and 5B represents one possible embodiment of a protuberance that will create a gap 37 between window frame 16 and framing members 14. Some alternative embodiments comprise a plurality of protuberances on each clip 30. Some alternative embodiments comprise one or more protuberances that project in the opposing direction from an opposite surface of middle portion 31 (i.e. towards framing members 14). In other alternative embodiments, clip 30 comprises one or more protuberances which project in an interior direction from a surface of portion 39B to provide a gap between window flange 20 (and portion 39B of clip 30) and the exterior surface of sheathing 12. Such a gap may communicate with gap 37 to facilitate the exchange of gas and/or moisture. In still other alternative embodiments, the relative thickness of middle portion 31 (and/or portion 39B) of clip 30 are increased, so that clip 30 can act as a spacer to provide gaps between a window frame and adjacent structures.

Figure 6A:
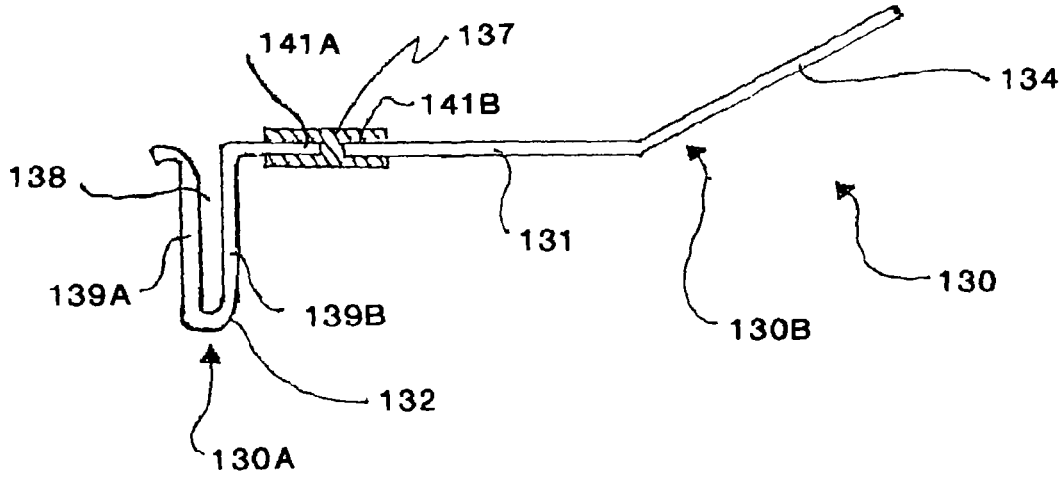
FIGS. 6A and 6B are respectively cross-sectional and isometric views of a window mounting clip according to another alternative embodiment of the invention.
Figure 6B:
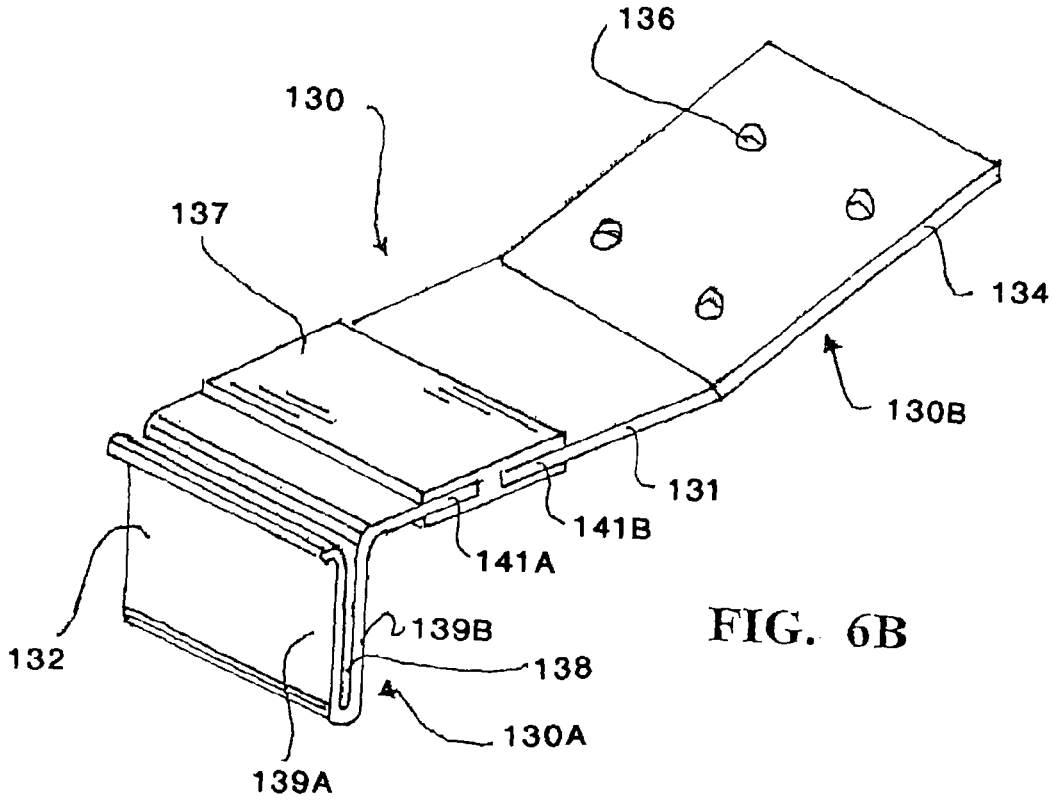

FIGS. 6A and 6B are respectively cross-sectional and isometric views of a clip 130 according to a further alternative embodiment of the invention. Clip 130 comprises a plurality of pieces, which include exterior piece 130A, interior piece 130B and thermal isolation coupling 137. As shown in FIGS. 6A and 6B, exterior piece 130A preferably comprises exterior end 132, including portions 139A, 139B which define deep groove 138. Interior piece 130B preferably comprises interior end 134 and middle portion 131. Thermal isolation coupling 137 couples interior piece 130B to exterior piece 130A and provides thermal insulation therebetween. Thermal isolation coupling 137 is fabricated from a material (or materials) that are thermally insulating relative to the material of exterior and interior pieces 130A, 130B. For example, exterior and interior pieces 130A, 130B may comprise steel or some other metallic alloy., while thermal isolation coupling 137 may comprise rubber, plastic, vinyl, fiberglass or the like. Thermal isolation of interior piece 130B from exterior piece 130A reduces the possibility of moisture condensing on interior piece 130B due to cold temperatures experienced by exterior piece 130A.

In the illustrated embodiment; thermal isolation coupling 137 comprises grooves 141A, 141B for respectively receiving the ends of exterior and interior pieces 130A, 130B. Preferably, thermal isolation coupling 137 is fabricated from a resilient material, such that when exterior and interior pieces 130A, 130B are inserted into grooves 141A, 141B, the deformation of grooves 141A, 141B acts to hold the ends of exterior and interior pieces 130A, 130B in-place (i.e. to couple the ends of exterior and interior pieces 130A, 130B to thermal isolation coupling 137). In alternative embodiments, adhesive, rivets and/or other suitable fasteners may be used to help couple the ends of exterior and interior pieces 130A, 130B to thermal isolation coupling 137. Thermal isolation coupling 137 may be molded in place around the ends of pieces 130A, 130B. Exterior and interior pieces 130A, 130B may be coated with a coating layer (not shown) which is thermally non-conductive relative to the material of exterior and interior pieces 130A, 130B. Such a coating layer may also help reduce or prevent condensation on the surface(s) of exterior and interior pieces 130A, 130B.

It can be appreciated that the use of this invention can significantly simplify the installation of prefabricated construction units in a building, especially where one would need a ladder, scaffold, man lift or the like to reach the locations where-the construction units will be installed from the exterior of the building. A worker can affix clips 30 according to the invention to a construction unit and then, from inside the structure, orient the construction unit at an angle to the aperture in which the construction unit will be installed and pass the construction unit through the aperture to the outside of the structure. Still working from inside the structure, the worker can then draw the construction unit into place in the aperture and fasten the construction unit in place by affixing interior ends 34 of clips 30 to the structure. If necessary, shims may be installed around the frame of the construction unit to properly align the construction unit in the aperture.

A further advantage of the invention is realized in situations where a waterproofing membrane or the like is applied to the exterior of building frame 10. Prior art systems for securing construction units to building structures typically require the membrane to be punctured by nails or screws in the area adjacent to aperture 13. In some cases building codes prohibit fastening the lower sides of construction units in ways which result in the membrane being punctured. Sometimes windows are installed with no fasteners on their lower sides for this reason. The result can be that the lower sides of the windows can move, especially in windy weather. The use of clips 30 according to the invention allows the membrane to remain intact and still permits securing the lower side of window units and other construction units by way of one or more clips 30.

It can be appreciated that clips 30 having an exterior end 32 as described above can be affixed to a construction unit frame with minimal tools and without the need to drill holes in the frame or to modify the window or door frame in other respects.

Where a component (e.g. a member, tab, fastener etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

While the above detailed description relates primarily to window units, it is to be understood that clips according to the invention may equally be used to secure other types of construction units, such as door units, vent units, sunlight units and the like, into appropriately sized apertures in a building frame.

In some embodiments, a layer of deformable, elastomeric material (not shown) may be attached to one (or both) of the surfaces of middle portion 31 of clip 30. Such deformable, elastomeric layer(s) may make clip 30 more malleable, thereby facilitating installation of clip 30 and preventing clip 30 from accidentally damaging window unit 15 or frame 10. Such deformable, elastomeric layer (s) may also help to accommodate warpage in the shape of the edges of window unit 15 and/or framing members 14. Similar deformable, elastomeric layer(s) may be used with all of the above-discussed clip embodiments.

Figure 7A:
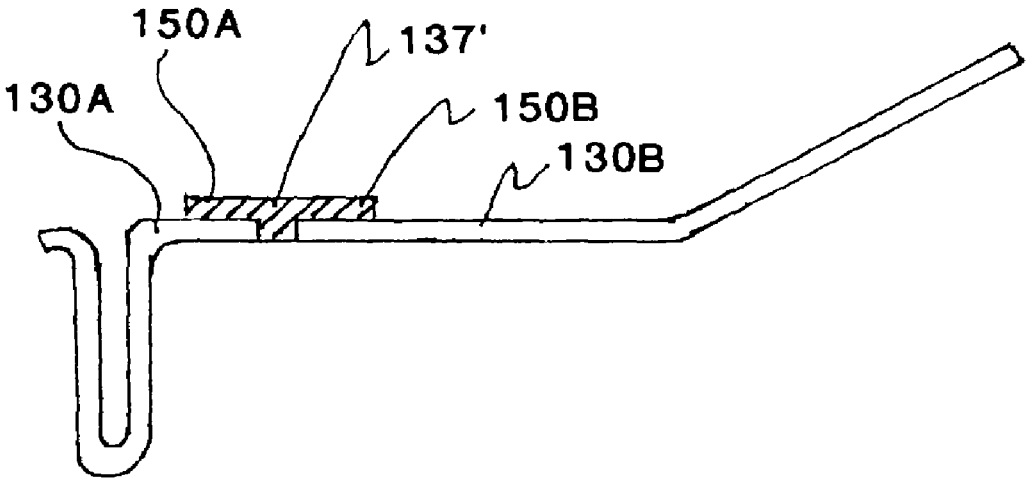
FIGS. 7A and 7B are cross-sectional views of window mounting clips according to still further embodiments of the invention.
Figure 7B:
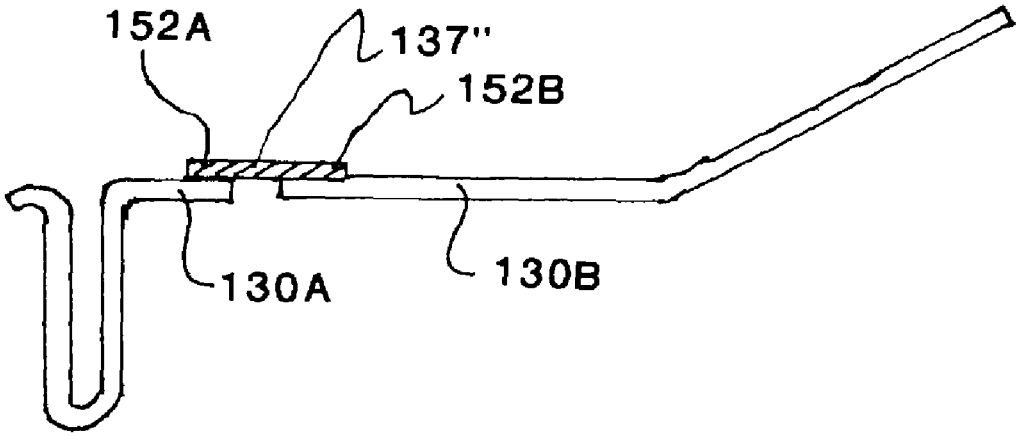

In some embodiments, thermal isolation coupling 137 may have a different shape than the one depicted in FIGS. 6A and 6B and may be coupled to exterior and interior pieces 130A, 130B in a different manner than that depicted in FIGS. 6A and 6B. FIGS. 7A and 7B respectively depict cross-sectional views of window mounting clips according to still further embodiments of the invention. Clip 130 of FIG. 7A comprises an exterior piece 130A and an interior piece 130B. Pieces 130A, 130B are coupled to one another by a thermal isolation coupling 137' that is T-shaped in cross section, with flanges 150A, 150B that extend over pieces 130A, 130B. Thermal isolation coupling 137' may be coupled to exterior and interior pieces 130A, 130B using adhesive, rivets and/or other suitable fasteners (not shown). Those skilled in the art will appreciate that T-shaped thermal isolation coupling 137' may be inverted (relative to pieces 130A, 130B) such that flanges 150A, 150B extend under pieces 130A, 130B. In the embodiment of FIG. 7B, exterior and interior pieces 130A, 130B are coupled together by a relatively flat-shaped thermal isolation coupling 137". Thermal isolation coupling 137" comprises exterior and interior ends 152A, 152B, which extend respectively over pieces 130A, 130B. Thermal isolation coupling 137" may be coupled to pieces 130A, 130B using adhesive, rivets and/or other suitable fasteners (not shown). Those skilled in the art will appreciate that flanges 152A, 152B of thermal isolation coupling 137" may alternatively extend below pieces 130A, 130B or both above and below pieces 130A, 130B. Thermal isolation couplings 137', 137" are preferably thermally non-conductive relative to the material of exterior and interior pieces 130A, 130B.

Accordingly, the scope of the invention is to be construed in accordance with the substance defined by the following claims.

What is claimed is:

1. A clip for affixing a construction unit to a building structure, the clip comprising:

a generally planar middle portion, an exterior portion located on an exterior side of the middle portion and an interior portion located on an interior side of the middle portion;

the exterior portion comprising a groove at an exterior end of the clip for receiving a construction unit flange, the groove having a generally U-shaped cross-section, the groove defined at least in part by a pair of generally parallel groove portions and a base portion connecting the groove portions at a base of the groove, the base of the groove spaced apart from an opening of the groove;

the middle portion extending from an interior side of groove toward the interior portion; and the interior portion at an interior end of the clip, the interior portion extending from the middle portion at an obtuse angle to define a fulcrum at a junction between the middle portion and the interior portion.

2. A clip according to claim 1 wherein the interior portion comprises one or more attachment points.

3. A clip according to claim 2 wherein the one or more attachment points include one or more apertures, one or more projections, or one or more apertures and one or more projections.

4. A clip according to claim 1 wherein at least one of the groove portions comprises one or more projections that project into the groove and toward the base of the groove.

5. A clip according to claim 1 wherein the middle portion comprises an exterior member, an interior member and a thermally isolating coupling member, the exterior and interior members are coupled to opposing sides of the coupling member.

6. A clip according to claim 5 wherein a thermal conductivity of the thermally isolating coupling member is lower than the exterior portion and the interior portion.

7. A clip according to claim 5 wherein the thermally isolating coupling member comprises a pair of grooves on its opposing sides, each groove receiving an end of one of the interior and exterior members.

8. A clip according to claim 5 wherein the thermally isolating coupling member is made of a material selected from the group consisting of: plastic, rubber, vinyl or fiberglass.

9. A clip according to claim 1 wherein the clip is coated with a layer of material which is thermally non-conductive relative to a remainder of the clip.

10. A clip according to claim 1 wherein the middle portion is thicker than the exterior and interior portions.

11. A clip according to claim 1 wherein the middle portion comprises one or more protuberances which project from a surface thereof.

12. A clip according to claim 1 comprising a layer of deformable, elastomeric material attached to a surface of the middle portion.

13. A clip according to claim 1 wherein the opening of the groove is defined by interior and exterior groove-opening portions that extend respectively away from interior and exterior ones of the groove portions, the exterior groove-opening portion tapered to extend further away from the interior one of the groove-opening portions as it extends further away from the exterior groove portion.

14. A clip according to claim 13 wherein the exterior groove-opening portions is smoothly curved.

15. A clip according to claim 1 wherein the clip is integrally formed from a bent strip of a resilient material.

16. A clip according to claim 15 wherein the resilient material is steel.

17. A clip according to claim 1 wherein an interior of the obtuse angle opens toward a side of the clip and the groove opening opens toward the same side of the clip.

18. A clip according to claim 1 wherein the obtuse angle is shaped such that the exterior portion is closer to the opening of the groove than the base of the groove.

19. A clip according to claim 18 wherein the opening of the groove is defined by interior and exterior groove-opening portions that extend respectively away from interior and exterior ones of the pair of groove portions, the exterior groove-opening portion tapered to extend further away from the interior one of the groove-opening portions as it extends further away from the exterior groove portion.

20. A clip according to claim 19 wherein at least one of the interior and exterior groove portions comprises one or more projections that project into the groove and toward the base of the groove.

* * * * *